US007438396B2

(12) United States Patent
Weksler et al.

(10) Patent No.: US 7,438,396 B2
(45) Date of Patent: Oct. 21, 2008

(54) INKJET PRINTING METHOD AND APPARATUS

(75) Inventors: Meir Weksler, Mazkeret Batia (IL); Yehoshua Sheinman, RaAnana (IL); Lior Lifshitz, Maoz Zion (IL)

(73) Assignee: Jemtex Ink Jet Printing Ltd., Lod (IL)

( * ) Notice: Subject to any disclaimer, the term of this patent is extended or adjusted under 35 U.S.C. 154(b) by 600 days.

(21) Appl. No.: 10/536,188

(22) PCT Filed: Nov. 24, 2003

(86) PCT No.: PCT/IL03/00988

§ 371 (c)(1),
(2), (4) Date: May 24, 2005

(87) PCT Pub. No.: WO2004/048099

PCT Pub. Date: Jun. 10, 2004

(65) Prior Publication Data

US 2006/0055746 A1 Mar. 16, 2006

Related U.S. Application Data

(60) Provisional application No. 60/428,683, filed on Nov. 25, 2002.

(51) Int. Cl.
*B41J 2/02* (2006.01)

(52) U.S. Cl. ..... 347/73; 347/75; 347/77; 347/78; 347/14

(58) Field of Classification Search ..... 347/14, 347/19, 55, 73, 76, 77, 78, 80, 82, 90, 75
See application file for complete search history.

(56) References Cited

U.S. PATENT DOCUMENTS

| | | | | | |
|---|---|---|---|---|---|
| 4,054,882 | A | | 10/1977 | Ruscitto | 347/76 |
| 4,384,296 | A | | 5/1983 | Torpey | 347/77 |
| 4,395,716 | A | | 7/1983 | Crean et al. | 347/76 |
| 4,472,722 | A | | 9/1984 | Ebi | 347/76 |
| 4,525,721 | A | | 6/1985 | Crean | 347/76 |
| 4,551,731 | A | * | 11/1985 | Lewis et al. | 347/78 |
| 4,827,287 | A | * | 5/1989 | Braun et al. | 347/75 |

(Continued)

FOREIGN PATENT DOCUMENTS

| | | |
|---|---|---|
| WO | WO 02/090119 | 11/2002 |
| WO | WO 03/059626 | 7/2003 |

*Primary Examiner*—Juanita D Stephens

(57) ABSTRACT

A method and apparatus for inkjet printing by means of a plurality of inkjet nozzles arranged in at least one row and having spaced, parallel nozzle axes for emitting liquid ink drops towards the substrate, and multi-level charging and deflecting plates controlled to deflect individual drops to selected locations on the substrate with respect to the respective nozzle axis according to the pattern to be printed. The multi-level charging and deflecting plates are controlled to cover, for each nozzle, a line section which includes two non-contiguous deposit zones to receive ink drops from the respective nozzle, separated by a non-deposit zone not to receive ink drops from the respective nozzle. Various arrangements are described, wherein the nozzles are arranged in a single row or two staggered rows; the printing is effected in a single pass or two passes; the nozzle line sections are overlapping, contiguous or spaced from each other; and the deposit zone of one nozzle overlaps at least a part of the deposit zone of another nozzle.

39 Claims, 8 Drawing Sheets

U.S. PATENT DOCUMENTS

| | | | | |
|---|---|---|---|---|
| 5,408,255 | A | 4/1995 | Emerson | 347/80 |
| 5,502,473 | A | 3/1996 | East et al. | 347/73 |
| 5,969,733 | A | 10/1999 | Sheinman | 347/75 |
| 6,003,980 | A | 12/1999 | Sheinman et al. | 347/78 |
| 6,074,045 | A | 6/2000 | Bergman et al. | 347/55 |
| 6,079,821 | A | 6/2000 | Chwalek et al. | 347/82 |
| 6,106,107 | A | 8/2000 | Sheinman | 347/75 |
| 6,481,835 | B2 | 11/2002 | Hawkins et al. | 347/77 |

* cited by examiner

Fig. 12
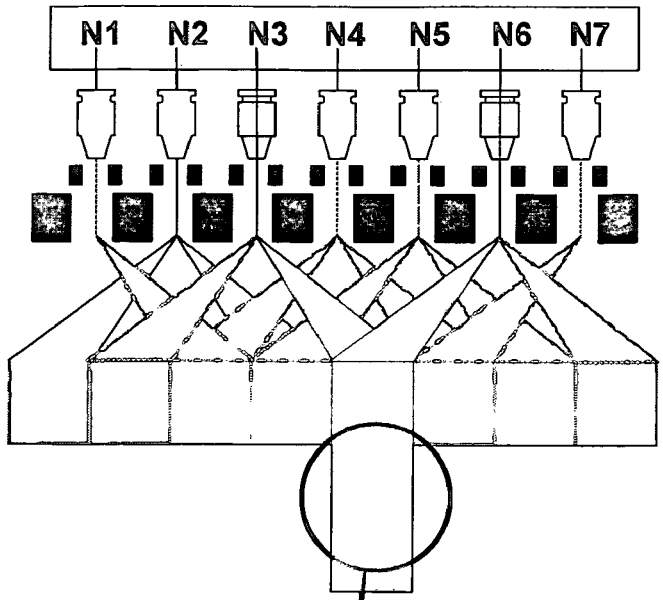
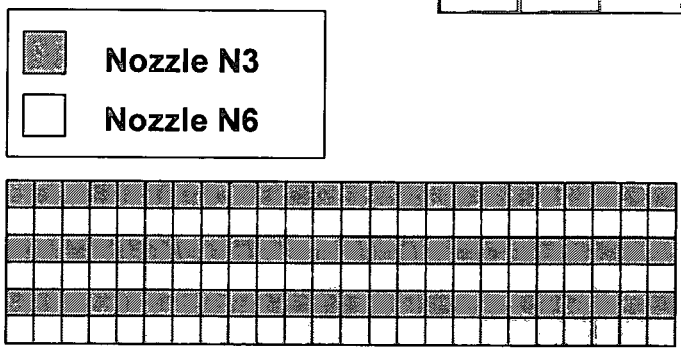
Fig. 12a
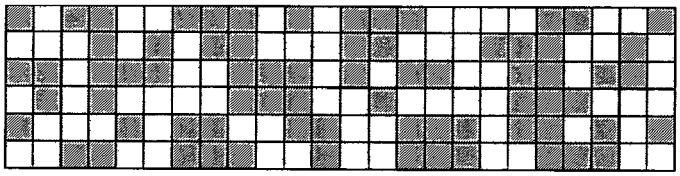
Fig. 12b
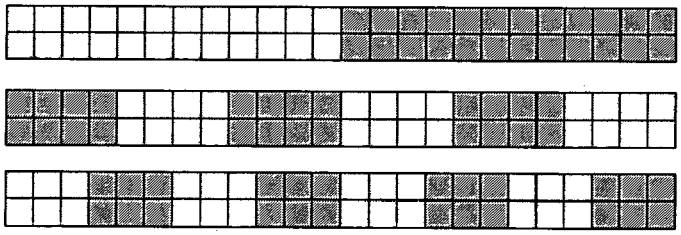
Fig. 12c
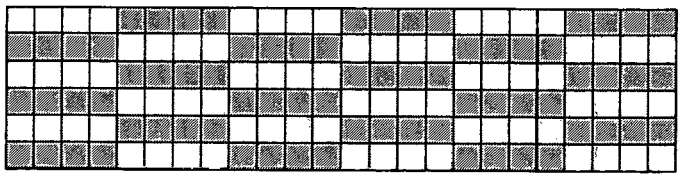
Fig. 12d

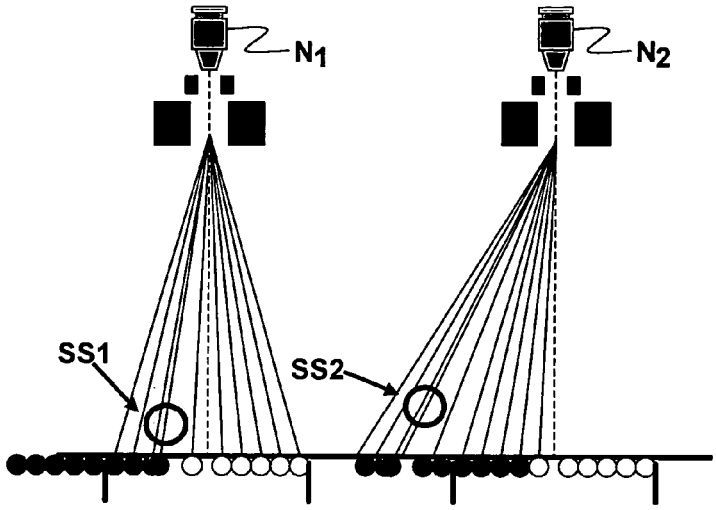
Fig. 13a Fig. 13b
Fig. 14
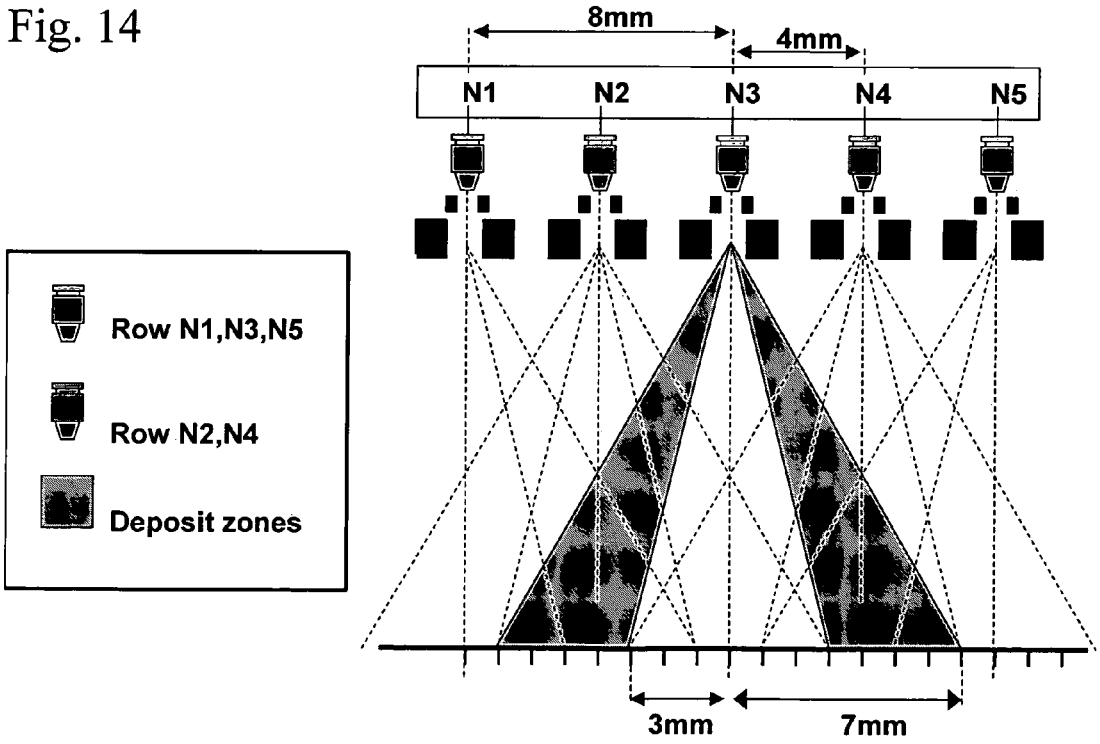

INKJET PRINTING METHOD AND APPARATUS

RELATED PATENT APPLICATION

This application is a National Phase Application of PCT/IL03/00988 having International Filing Date of 24 Nov. 2003, which claims the benefit of U.S. Provisional Patent Application No. 60/428,683 filed 25 Nov. 2002.

FIELD AND BACKGROUND OF INVENTION

The present invention relates to inkjet printing method and apparatus of the type described in our prior U.S. Pat. Nos. 5,969,733, 6,003,980 and 6,106,107, and also in our prior International Patent Applications PCT/IL02/00346 and PCT/IL02/01064, published as International Publications. WO 02/090119 A2 and WO03/059626 A2, respectively, the contents of which patents and application are incorporated herein by reference.

Inkjet printers are based on forming drops of liquid ink and selectively depositing the ink drops on a substrate. The known inkjet printers generally fall into two categories: droplet-on-demand printers, and continuous-jet printers. Droplet-on-demand printers selectively form and deposit the inkjet drops on the substrate as and when demanded by a control signal from an external data source; whereas continuous-jet printers are stimulated by a perturbation device, such as a piezoelectric transducer, to emit a continuous stream of ink drops at a rate determined by the perturbation device.

In continuous-jet printers, the drops are selectively charged and deflected to direct them onto the substrate according to the desired pattern to be printed. In binary-type printer systems, the drops are either charged or uncharged and, accordingly, either reach or do not reach the substrate at a single predetermined position. In a multi-level system, the drops can receive a large number of charge levels and, accordingly, can generate a large number of print positions. Both types of systems generally include a gutter for receiving the ink drops not to be printed on the substrate.

The present invention is particularly applicable to continuous-jet printers and is therefore described below with respect to this application. It will be appreciated, however, that aspects of the invention could also be used in droplet-on-demand printers or in other applications.

Continuous, multi-level deflection inkjet technology exists for about 30 years. It is mainly used for low quality, high speed marking. The basic technology is described in U.S. Pat. No. 4,551,731 for example. The system includes of a row of nozzles each of which emits a continuous stream of separate ink drops. Downstream of each nozzle are multi-level charging and deflecting plates for charging each drop and for deflecting the charged drops to selected locations on the substrate according to the pattern to be printed. The system is controlled by a controller that activates and synchronizes the emission, charging and deflection of the drops, and various motions in the system, in order to print a desired pattern, e.g., graphic information, alphanumerical characters, or a combination of both. Each nozzle covers a given line section on the substrate or printing plane.

There are several mechanical configurations for continuous inkjet (CIJ) printing heads. U.S. Pat. No. 4,551,731 describes a configuration wherein the printing drops are deflected to one side (mono-polarity), and non-printing drops fall without deflection (free fall) to the gutters which are located immediately under the nozzles (FIG. 1). Another configuration appears in U.S. Pat. No. 4,395,716 wherein the printing drops are deflected to both sides of the nozzles axis (bi-polarity) to define a line section located under the nozzle, while the non-printing drops are deflected to a gutter located far to the side. In a special implementation (FIG. 2), the gutters are placed on the grounded deflection plates, enabling very large deflections for the printing drops.

The above two multi-level deflection (MLD) configurations are generally characterized by several drawbacks, particularly the following:

1. The mono-polar configuration requires large deflections to one side only. In order to cover large line sections, it is necessary to apply very large charges to the drops. This causes problems of electrostatic interactions between drops in the air. Additionally, it is impossible to use the free falling drops for calibrating the system as they end up in the gutter and not on the printing plane.

2. The bi-polar configuration overcomes some of the problems mentioned above. However, since the gutter drops are heavily charged, they may have interactions with the writing drops. Moreover, because of the extreme position of the gutters, in case of even a small system malfunction the gutter drops may miss the gutters and either hit the deflection plates causing electrical shorts, and/or hit the printed substrate causing a major printing failure.

3. In both configurations, any printing defects in a nozzle will appear in the same relative location on the substrate, and will therefore affect the printing quality.

As there is a relative motion between the print head and the substrate, each nozzle repeatedly prints short line sections of data. For each graphic combination of such a line section, there is a corresponding combination of charging voltages, designed to bring each droplet to its required position on the substrate. The object of many patents is to improve the design of these voltage combinations in order to improve the printing accuracy. Because of electrostatic and aerodynamic interactions between the drops, this task is very complicated. U.S. Pat. Nos. 4,054,882, 4,395,716, 4,525,721, 4,472,722 all deal with methods for the separation and staggering of drops in the air, in order to minimize the interactions between them. However, because of these interactions and other factors in the system, it is very difficult to avoid errors in droplet placement, resulting in printing errors on the substrate.

OBJECTS AND BRIEF SUMMARY OF THE PRESENT INVENTION

An object of the present invention is to provide an inkjet printing method and apparatus having advantages in one or more of the above respects, as will be described more particularly below.

According to one broad aspect of the present invention, there is provided a method of inkjet printing a desired pattern on a substrate by means of a plurality of inkjet nozzles arranged in at least one row and having spaced, parallel nozzle axes for emitting liquid ink drops towards the substrate, and multi-level charging and deflecting plates controlled to deflect individual drops to selected locations on the substrate with respect to the respective nozzle axis according to the pattern to be printed; characterized in that the multi-level charging and deflecting plates of the nozzles are controlled to deflect the ink drops of each nozzle to selected locations within a line section for each nozzle, which line section includes two non-contiguous deposit zones to receive ink drops from the respective nozzle, separated by a non-deposit zone not to receive ink drops from the respective nozzle.

As indicated earlier, the present invention is particularly useful with respect to continuous, multi-level inkjet printers, wherein each of the nozzles is controlled to emit a continuous stream of ink drops, and wherein the multi-level charging and deflecting plates of the nozzles are controlled so as to permit those ink drops not to be printed to progress substantially along the respective nozzle axis and to be intercepted by gutters aligned with the respective nozzle axes before reaching the substrate.

According to a more specific aspect of the present invention, therefore, there is provided a method of inkjet printing a desired pattern on a substrate comprising: controlling a plurality of inkjet nozzles, arranged in at least one row and having spaced, parallel nozzle axes, to emit a continuous stream of liquid ink drops towards the substrate; and controlling multi-level charging and deflecting plates to deflect individual drops to selected locations in a line section of the substrate for each nozzle according to the pattern to be printed; characterized in that the multi-level charging and deflecting plates are controlled such that each line section for each nozzle includes two non-contiguous deposit zones to receive ink drops from the respective nozzle, separated by a non-deposit zone not to receive ink drops from the respective nozzle; and such that the ink drops not to be printed are permitted to progress substantially along the respective nozzle axes and to be intercepted by gutters aligned with the respective nozzle axes before reaching the substrate.

As will be described more particularly below, the invention may be implemented according to a wide number of configurations, depending on the requirements of any particular application regarding cost, size, printing speed, printing quality, etc. Various arrangements are described below, for purposes of example, wherein: the nozzles are arranged in a single row or two rows staggered with respect to each other, the printing is effected in a single pass or two passes; the nozzle line sections are overlapping, contiguous or spaced from each other; and the deposit zone of one nozzle overlaps at least a part of the deposit zone of another nozzle.

For example, several implementations are described wherein the line sections of the row of nozzles are non-overlapping, i.e., the line sections of the row of nozzles are contiguous, or are spaced from each other.

In one described embodiment including non-overlapping line sections, the plurality of nozzles are arranged in at least two rows, in which the nozzles of one row are staggered with respect to those of the other row such that the deposit zones of the nozzles line sections in one row at least partly cover the non-deposit zones of the nozzle line section in the other row. In a second described embodiment including non-overlapping line sections, the plurality of nozzles are arranged in a single row, and the printing on the substrate is effected in two passes of the nozzles with respect to the substrate, in which the second pass is preceded by a lateral shift of the nozzles relative to the substrate in the first pass, such that the deposit zones of the nozzle line sections during the second pass cover the non-deposit zones of the nozzle line sections during the first pass.

Other embodiments are described wherein at least some of the nozzle line sections are overlapping such that the non-deposit zone of a nozzle line section is at least partly covered by deposit zone of at least one other nozzle line section. In some described embodiments, the deposit zones of at least some of the nozzle line sections are not overlapping, such that each deposit zone of the respective nozzle line section covers only a part of the non-deposit zone of another nozzle line section. In another described embodiment, the deposit zones of at least some of the nozzle line sections are overlapping, such that at least a part of the non-deposit zones of the respective nozzle line sections receives ink drops from at least two other nozzles.

With respect to the latter embodiments, one embodiment is described wherein the parts of the non-deposit zones receiving ink drops from at least two other nozzles receive the ink drops in an interlaced manner. Another embodiment is described wherein the parts of the non-deposit zones receiving ink drops from at least two other nozzles receive the ink drops in a random manner to blur possible printing defects in a nozzle. A still further embodiment is described wherein the parts of the non-deposit zones receiving ink drops from at least two other nozzles receive the ink drops according to a pre-fixed distribution ratio to increase the throughput of the nozzles and/or to blur possible printing defects in a nozzle. With respect to the latter embodiment, the pre-fixed distribution ratio may be changed when printing subsequent line sections to thereby further increase the blurring effect and thereby enhance the image quality.

A further embodiment is described wherein the deposit zones of at least some of the nozzle line sections are overlapping such that each receives ink drops from at least two nozzles on each side.

According to another aspect of the present invention, there is provided printing apparatus for printing desired patterns on a substrate, comprising: at least one row of inkjet nozzles having spaced, parallel nozzle axes for emitting ink drops towards the substrate; multi-level charging and deflecting plates for each nozzle for charging and deflecting the ink drops emitted by the respective nozzle; and a controller for controlling the multi-level charging and deflecting plates to deflect individual drops to selected locations in a line section of the substrate for each nozzle, which line section includes two non-contiguous deposit zones to receive ink drops from the respective nozzle, separated by a non-deposit zone not to receive ink drops from the respective nozzle.

As indicated above, the invention is particularly useful in continuous-jet printing apparatus, wherein the apparatus further comprises a gutter for each nozzle substantially aligned with the nozzle axis of the respective nozzle; and wherein the controller controls the nozzles to emit a continuous stream of ink drops towards the substrate, and controls the multi-level charging and deflecting plates to permit the ink drops not to be printed to progress substantially along the respective nozzle axis and to be intercepted by gutters aligned with the respective nozzle axis before reaching the substrate.

According to a further aspect of the invention, there is provided a method of calibrating an inkjet printer having a plurality of nozzles and a gutter in alignment with each nozzle axis for intercepting ink drops before reaching the substrate, comprising: precisely positioning the gutters in alignment with their respective nozzle axes; and when necessary, applying a small electrical charge to the non-printing drops to direct them precisely to the centers of their respective gutters, thereby enabling the gutters to have a minimum profile.

As will be described more particularly below, the present invention enables inkjet printing to be performed having many or all of the following advantages over existing techniques: simpler and more compact print heads; increase in the throughput of the printer; increase in the size of the line section covered by each nozzle; reduction in interactions between ink drops; increase in the reliability of the system by reducing its sensitivity to gutter drop charges; improvement in the positional accuracy of each ink drop; reduction in the effects of defects in the print heads that may otherwise be present in the system; and/or ability to continue to use conventional print heads without sacrificing their performance.

Further features and advantages of the invention will be apparent from the description below.

BRIEF DESCRIPTION OF THE DRAWINGS

The invention is herein described, by way of example only, with reference to the accompanying drawings, wherein:

FIG. 12 more particularly illustrates an overlapping configuration corresponding to that of FIG. 11 but highlighting one of the deposit zones (DZs);

FIGS. 12*a*-12*d* schematically illustrate various interleaving and interlacing arrangements that may be used in the overlapping configuration of FIG. 12 to blur printing defects that may be present in one or more of the nozzle constructions;

FIGS. 13*a* and 13*b* diagrammatically illustrate an additional technique, namely a side-shifting technique, that may be used to blur printing defects;

FIG. 14 illustrates an example of a nozzle configuration wherein the deposit zones (DZs) also receive ink drops from two other nozzles on each side thereof;

It is to be understood that the foregoing drawings, and the description below, are provided primarily for purposes of facilitating understanding the conceptual aspects of the invention and various possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

BRIEF DESCRIPTION OF THE PRIOR ART OF FIGS. 1 AND 2

Figure 1:
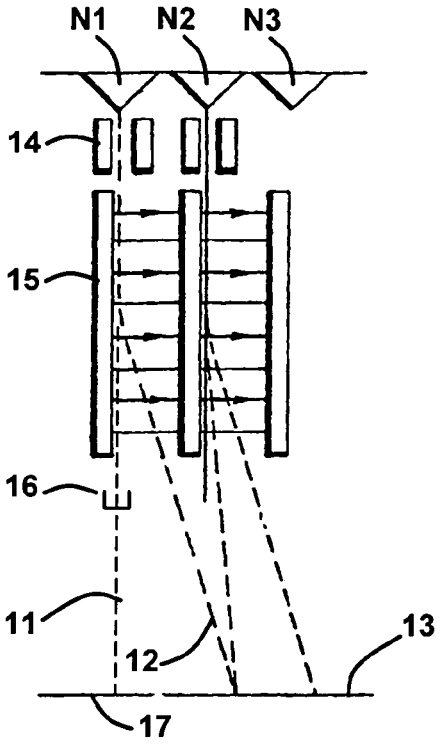
Fig. 1 (PRIOR ART)
FIGS. 1 and 2 diagrammatically illustrate prior art nozzle constructions of the mono-polarity and bi-polarity configurations, respectively, as briefly discussed above.
Figure 2:
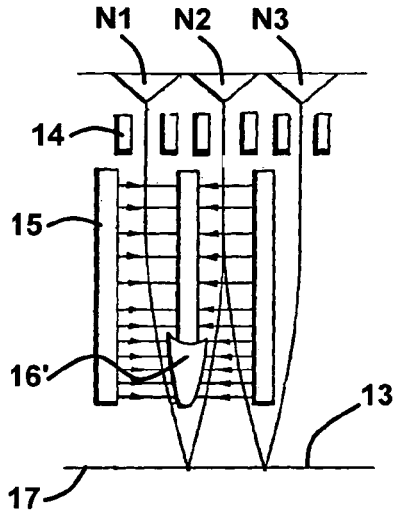
Fig. 2 (PRIOR ART)

FIGS. 1 and 2 diagrammatically illustrate prior art constructions of continuous jet printers of the mono-polarity (FIG. 1) and the bi-polarity (FIG. 2) types, respectively.

The printer illustrated in FIG. 1 includes a row of inkjet nozzles $N_1$-$N_3$ having spaced, parallel nozzle axes 11. Each nozzle N contains a reservoir of liquid ink emitting the liquid ink in the form of a continuous stream of ink drops 12 along the respective nozzle axis 11 towards the substrate 13 for deposition thereon according to the desired pattern to be printed. Each nozzle $N_1$-$N_3$ includes a perturbator (not shown), such as a piezoelectric transducer, which converts a jet filament of liquid ink into the continuous stream of liquid ink drops 12. The ink drops are initially directed along the respective nozzle axis 11 towards the substrate 13, but are selectively deflected by a pair of charging plates 14 and a pair of deflecting plates 15 both straddling the nozzle axis 11. The charging plates 14 selectively charge the drops at the instant of droplet break-off from the jet filament, and the deflecting plates 15 deflect the charged drops with respect to the nozzle axis 11 according to the pattern to be printed. The drops not to be printed by the respective nozzle are not charged. They are intercepted by a gutter 16 in alignment with the respective nozzle axis 11, and are recirculated back to the reservoir of the respective nozzle.

FIG. 1 illustrates a mono-polarity configuration, wherein the drops 12 to be printed are charged with different charges of one polarity so as to produce multi-level deflection to a line section 17 on one side of the nozzle axis 11, whereas the drops not to be printed fall without deflection (free fall) to the respective gutter 16.

FIG. 2 illustrates a bi-polarity configuration wherein the drops 12 to be printed are deflected to both sides of the respective nozzle axis 11, and the drops not to be printed are deflected to a gutter which is located far to the side of the respective nozzle axis, e.g., on a grounded deflection plate as shown at 16' in FIG. 2.

It will be seen that in both of the above prior art configurations, each nozzle covers a single line section 17 of the substrate 13 in which the nozzle either deposits, or does not deposit, an ink drop according to the pattern to be printed. It will also be seen that the line sections 17 of the row of nozzles are contiguous.

DESCRIPTION OF PREFERRED EMBODIMENTS OF THE PRESENT INVENTION

According to the present invention, the multi-level charging and deflecting plates of the row of inkjet nozzles are controlled to deflect the ink drops of each nozzle to selected locations within a line section for each nozzle, wherein each line section includes two non-contiguous deposit zones (DZs) to receive ink drops from the respective nozzle, separated by a non-deposit zone (NDZ) not to receive ink drops from the respective nozzle. The non-deposit zone of each nozzle is aligned with the respective nozzle axis. The deposit zones of each nozzle are located on opposite sides of the respective nozzle axis. The non-deposit zone of the line section of each nozzle is covered by the deposit zone of at least one other nozzle (which may be the same nozzle in a second pass of the substrate with respect to the print head) on each of the opposite sides of the respective nozzle axis, except for the end nozzles, wherein the non-deposit zone is covered only by the deposit zone of the one nozzle adjacent to the end nozzle. As will be described more particularly below, such a printing configuration which may be termed a split-segment printing configuration, provides many advantages particularly relating to print quality, machine reliability, printing speed, and compactness.

Figure 3:
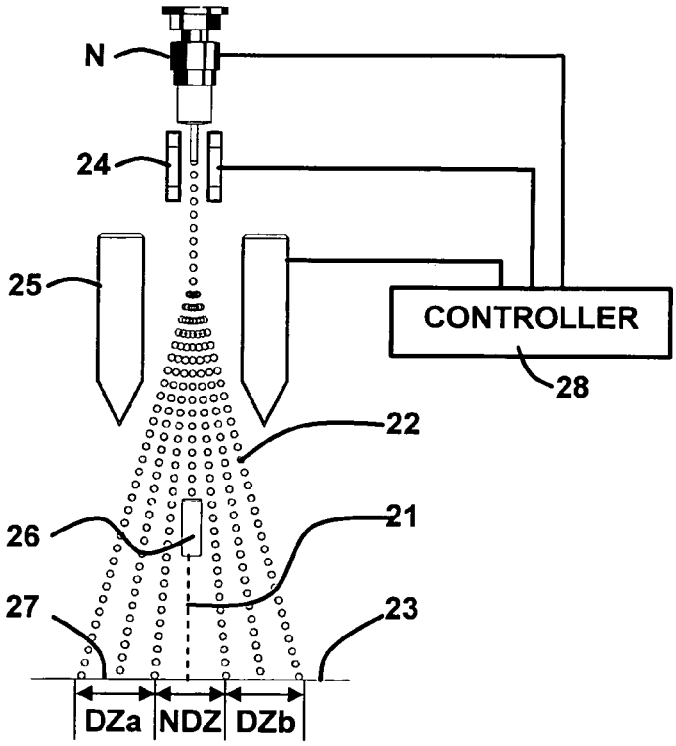
FIG. 3 diagrammatically illustrates a nozzle construction in accordance with the present invention.

A nozzle constructed and controlled as described above in accordance with the present invention is illustrated in FIG. 3. Thus, as shown in FIG. 3, the nozzle N emits liquid ink drops 22 initially along its axis 21 towards the substrate 23, but the drops are deflected with respect to the nozzle axis by a pair of charging plates 24 and deflection plates 25 to selected locations within a line section 27 on the substrate 23 covered by the respective nozzle. Nozzle N further includes a gutter 26 for intercepting undeflected drops before reaching the substrate, which drops are recirculated to the ink reservoir for the nozzle. FIG. 3 also schematically illustrates the controller 28 for controlling the operation of the nozzle 20, particularly its perturbator (not shown), the charging plates 24, and the deflection plates 25, to deflect the ink drops of each nozzle to a selected location within the lines section 27 covered by the nozzle N.

As shown in FIG. 3, line section 27 covered by nozzle N includes two non-contiguous deposit zones $DZ_a$, $DZ_b$, to receive ink drops from the nozzle, separated by a non-deposit zone NDZ not to receive ink drops from the nozzle. The non-deposit zone NDZ is aligned with the respective nozzle axis 21, and the deposit zones $DZ_a$, $DZ_b$, are located on opposite sides of the nozzle axis. The two deposit zones are generally, but need not be, equal and symmetric.

While FIG. 3 illustrates the non-deposit zone NDZ of equal length at each of the two deposit zones $DZ_a$, $DZ_b$, this is but one example, as the non-deposit zone NDZ may have another length relative to that of the deposit zones, as will be shown in many other examples described below.

Figures 4, 5:
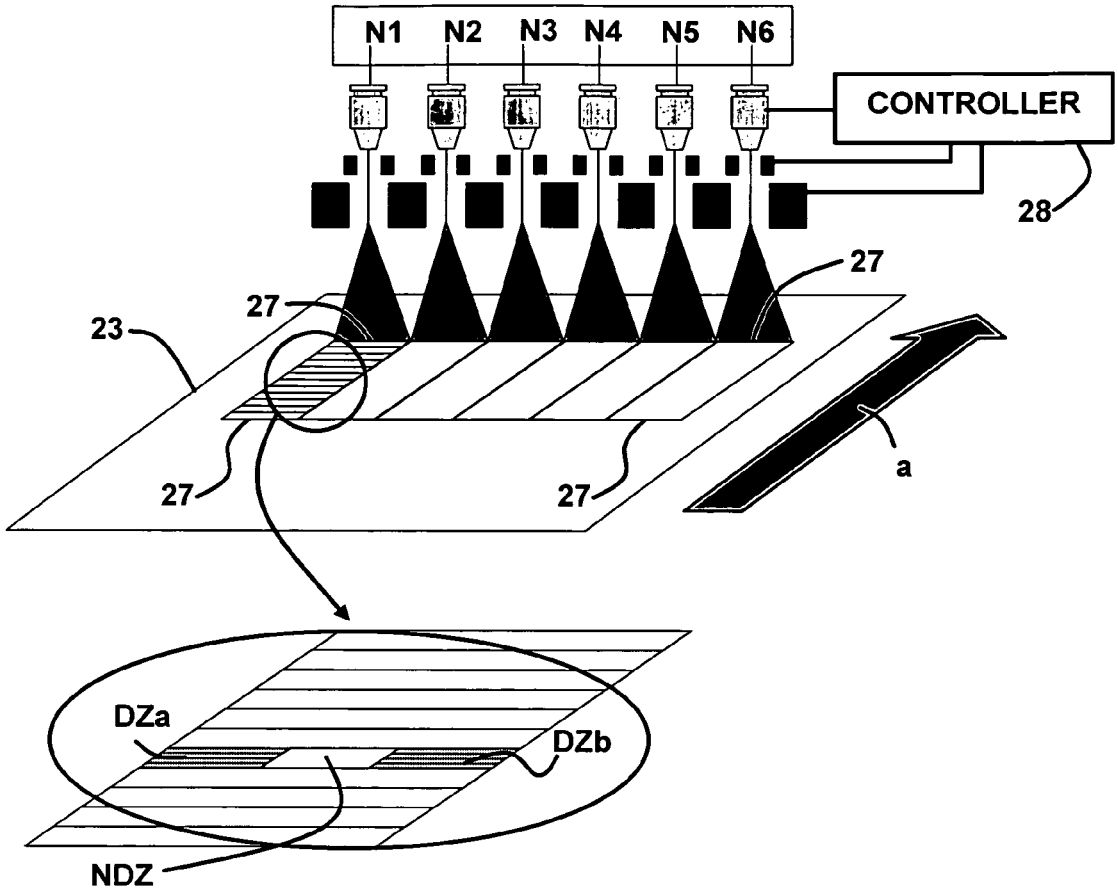
FIG. 4 diagrammatically illustrates a printing head including a row of nozzles arranged to print in contiguous line sections on the substrate.
FIG. 5 illustrates a line section produced by each nozzle, particularly the two non-contiguous deposit zones (DZs) of the line section to receive ink drops from the respective nozzle separated by a non-deposit zone (NDZ) not to receive ink drops from the respective nozzle.

FIG. 4 illustrates a row of nozzles $N_1$-$N_6$ arranged such that their respective line sections 27 are contiguous. FIG. 4 also illustrates the relative movement effected between the substrate 23 and the row of nozzles $N_1$-$N_6$ in the direction perpendicular to the row (as shown by arrow "a"), whereupon it will be seen that each nozzle deposits its ink drops sequentially in a series of line sections 27. As shown in FIG. 5, each such line section 27 is constituted of two non-contiguous deposit zones DZa, DZb, separated by a non-deposit zone NDZ.

In the example illustrated in FIG. 5, the two deposit zones DZa, DZb are of equal length, whereas the non-deposit zone NDZ is of twice the length of each deposit zone.

It will thus be seen that when the nozzles are arranged according to the contiguous configuration illustrated in FIG. 4, to produce contiguous line sections 27, those portions of the substrate 23 representing the non-deposit zones NDZ of each line section 27 would not receive ink drops from the nozzles. Therefore, when using a nozzle configuration producing contiguous line sections 27 (e.g., as in FIGS. 4 and 5), special means are to be provided to apply the ink drops also to the portions of the substrate represented by the non-deposit zones NDZs of the line sections 27.

Figure 6:
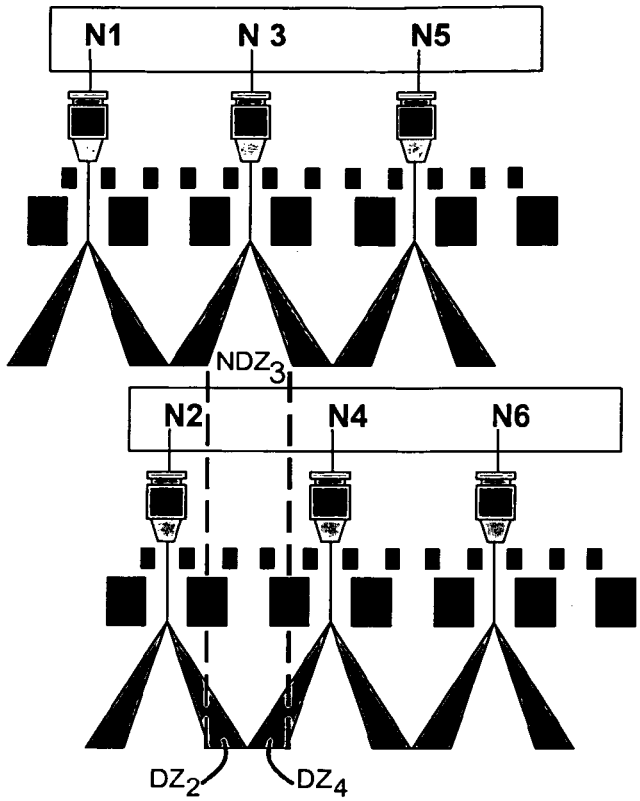
FIGS. 6 and 7 diagrammatically illustrate two arrangements that may be used when the line sections of the row of nozzles are contiguous as shown in FIG. 5, namely a single-pass printing arrangement including two rows of nozzles staggered with respect to each other (FIG. 6), and a double-pass printing arrangement including a single row of nozzles in which a lateral shift is effected between the two passes (FIG. 7)

FIG. 6 illustrates one arrangement for accomplishing this, namely by arranging the plurality of nozzles $N_1$-$N_6$ in at least two rows, in which the nozzles $N_1$, $N_3$, $N_5$ of one row are staggered with respect to those $N_2$, $N_4$, $N_6$ of the other row such that the deposit zones DZs of the nozzles in one row cover the non-deposit zones NDZs of the nozzles in the other row. During printing, there is a time delay between the signal sent to the nozzles of each row, so that the nozzles in both rows print along the same line section of the substrate during the movement of the substrate relative to the nozzles in the direction of arrow "a" (FIG. 4). It will thus be seen that when the line section 27 configuration illustrated in FIG. 5 is produced, the non-deposit zone NDZ produced by one row of nozzles will be covered by the deposit zones DZs in the other row straddling the respective nozzle in the first-mentioned row. This is shown in FIG. 6 with respect to nozzle $N_3$ wherein its non-deposit zone $NDZ_3$ is covered by deposit zones $DZ_2$ and $DZ_4$ of the two nozzles $N_2$, $N_4$, respectively, in the other row.

Such an arrangement thus permits the complete substrate to be printed in one pass of the print head with respect to the substrate.

Figure 7:
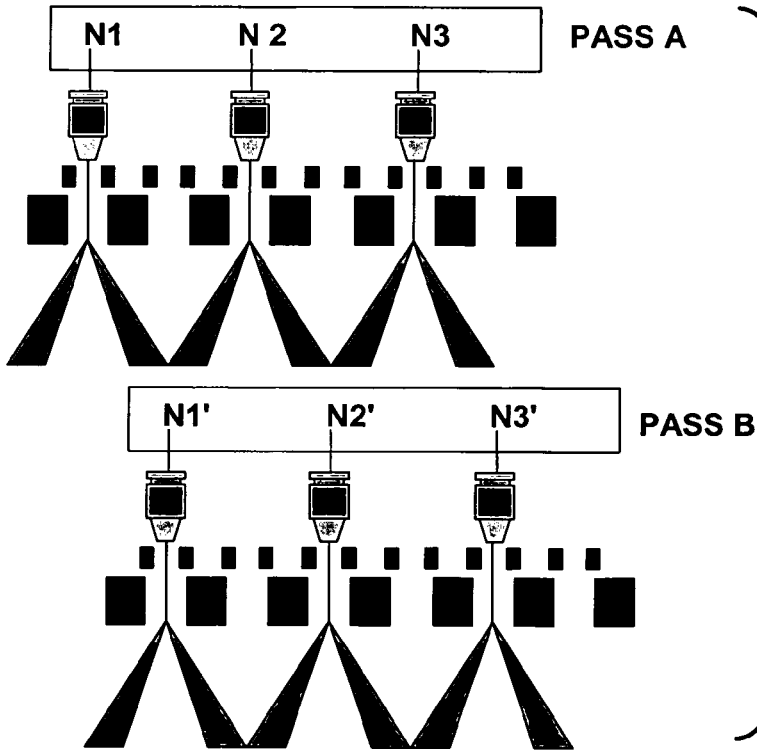

FIG. 7 illustrates one manner of using a contiguous line section configuration as in FIG. 4, but including a single row of nozzles $N_1$-$N_3$ to print the complete surface of the substrate. In such a case, the printing is effected in two passes, in which the second pass (pass B) is preceded by a lateral shift of the nozzle row relative to the substrate in the first pass (pass A), such that the deposit zones DZs of the nozzles in the second pass cover the non-deposit zones NDZs of the nozzles during the first pass. The second pass is indicated by nozzles $N_1$, $N_2$, $N_3$ and may be realized by using a shuttle head that scans the substrate across the substrate motion direction. Between the scans, there is a shift of one-half of the inter-nozzle distance, or any multiple of this distance, such that the deposit zones DZs of the nozzles in the second pass coincide with the non-deposit zones NDZs of the nozzles during the first pass.

Figure 8:
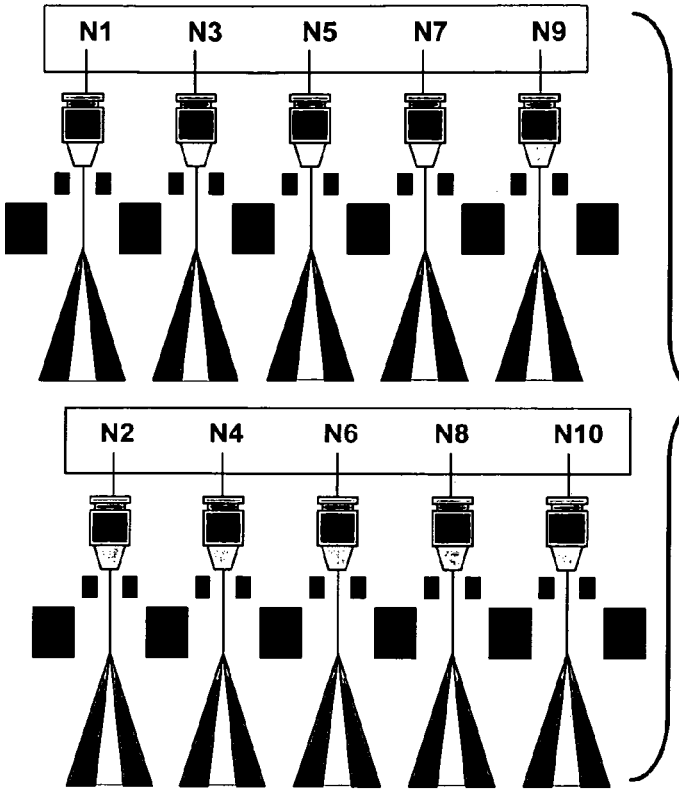
FIGS. 8 and 9 diagrammatically illustrate a single-pass printing arrangement, and a double-pass printing arrangement, respectively, when the line sections of the nozzle row are spaced from each other.
Figure 9:
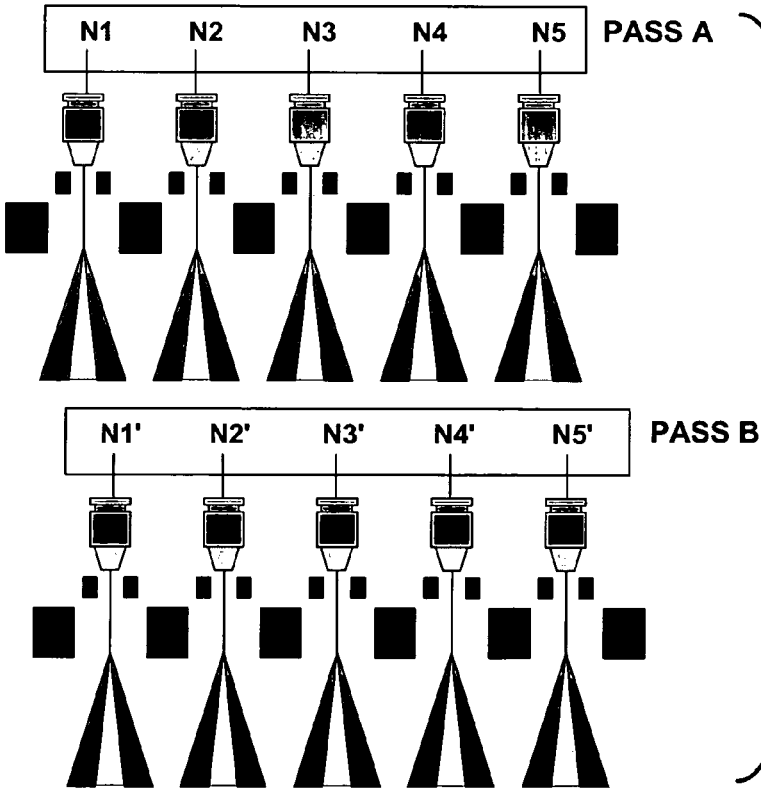

FIGS. 8 and 9 illustrates arrangements similar to those of FIGS. 6 and 7, respectively, but where the line sections printed by the nozzles are not contiguous, but rather are spaced from each other, in this case the length of one deposit zone DZ. Thus, FIG. 8 illustrates a print head wherein the nozzles $N_1$-$N_{10}$ are arranged in two rows, one row consisting of the oddly-numbered nozzles, and the other row consisting of the evenly-numbered nozzles, which nozzles are controlled as described above with respect to FIG. 6 to print a continuous line in a single pass; whereas FIG. 9 illustrates all the nozzles $N_1$-$N_5$ arranged in a single row with the printing effected in two passes, in which the second pass (pass B) is preceded by a lateral shift of the nozzles indicated at $N_1'$-$N_5'$, respectively, relative to the substrate in the first pass (pass A), as described above with respect to FIG. 7. However, the basic shift is different from FIG. 7, in that it is not half the inter-nozzle distance, but rather the length of the deposit zone DZ, which is smaller. In the configurations illustrated in FIGS. 8 and 9, the line section of each nozzle is spaced from that of the next nozzle by a distance equal to the length of the deposit zone DZ, and the length of the non-deposit zone NDZ of each nozzle is equal to the length of each of the two deposit zones DZs of the respective nozzle.

Figure 10:
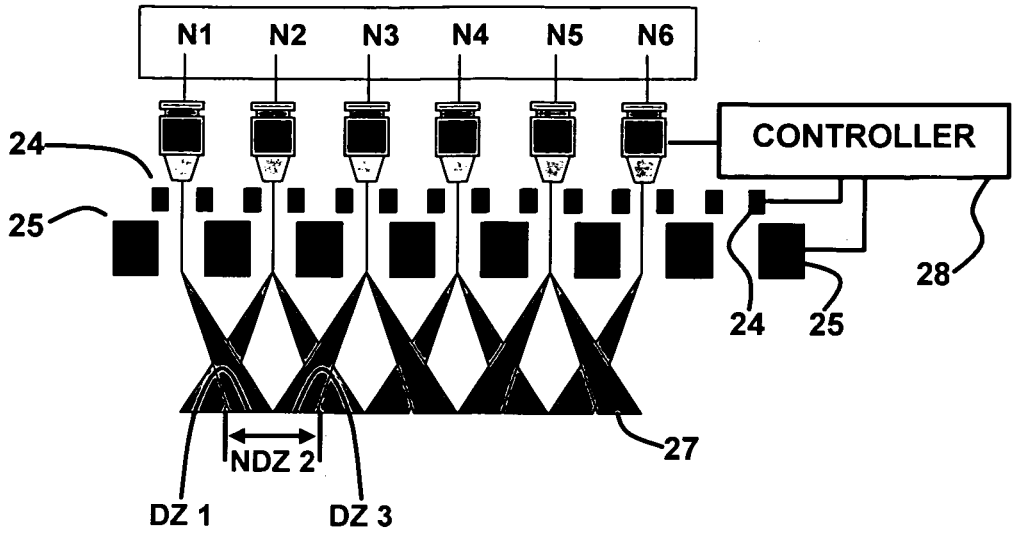
FIG. 10 diagrammatically illustrates a single-pass printing arrangement including a single row of nozzles wherein the line sections of the nozzle row are overlapping such that the non-deposit zone (NDZ) of each nozzle line section coincides with the deposit zone (DZ) of the line section of the nozzle on each side of the respective nozzle axis.

FIG. 10 illustrates a configuration wherein the line sections 27 of the row of nozzles $N_1$-$N_6$ are overlapping such that the non-deposit zone NDZ of each nozzle line section 27 coincides with the deposit zone of at least one other nozzle line section 27. In the configuration illustrated in FIG. 10, the line sections 27 of adjacent nozzles are overlapping, but the deposit zones DZs of adjacent nozzles are not overlapping. Thus, as shown in FIG. 10, the non-deposit zone $NDZ_2$ of nozzle $N_2$ is completely covered by the deposit zones $DZ_1$, $DZ_3$ of the two nozzles $N_1$, $N_3$ on opposite sides of nozzle $N_2$.

It will also be seen that in the configuration illustrated in FIG. 10, the charging plates and deflecting plates 24 of the two end nozzles $N_1$, and $N_6$ are controlled to deflect the ink drops therefrom only to one deposit zone DZ, namely to the one covering the non-deposit zone NDZ of the nozzle line section 27 adjacent to the respective end nozzle.

Figure 11:
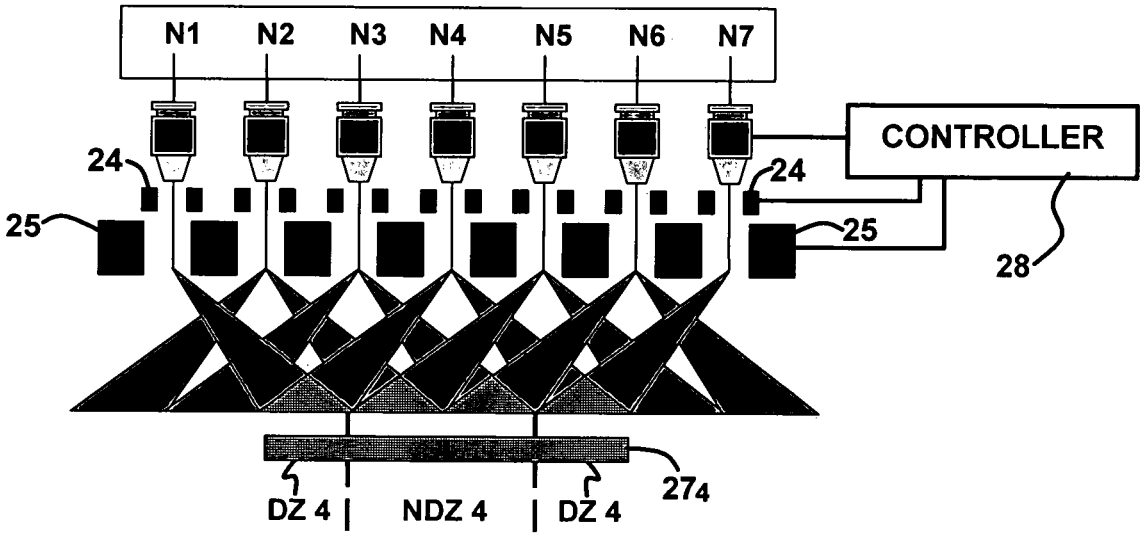
FIG. 11 illustrates an overlapping configuration, wherein there is overlapping not only of the nozzle line sections, but also of the deposit zones (DZs) in the line sections.

FIG. 11 illustrates an overlapping configuration wherein not only the line sections 27 of neighbor nozzles overlap, but also the deposit zones DZ of neighbor nozzles overlap. In addition, the non-deposit zone NDZ of a line section for one nozzle is twice the length of the deposit zone DZ of the respective nozzle. This overlap and full coverage is enabled since the deposit zones DZ are twice as large.

The foregoing are seen in FIG. 11 with respect to nozzle $N_4$, which illustrates its line section at $\mathbf{27}_4$. Thus, as shown in FIG. 11, at one side of line section $\mathbf{27}_4$, the deposit zone DZ of nozzle $N_4$ overlaps deposit zone $DZ_1$ of nozzle $N_1$, and on the opposite side, the deposit zone $DZ_4$ of nozzle $N_4$ overlaps deposit zone $DZ_7$ of nozzle $N_7$. In addition, the non-deposit zone NDZ of line section $\mathbf{27}_4$ for nozzle $N_4$ is covered by overlapping deposit zones $DZ_2$ and $DZ_5$ of nozzles $N_2$ and $N_5$, and by overlapping deposit zones $DZ_3$ and $DZ_6$ of nozzles $N_3$ and $N_6$.

The above-described arrangements, wherein the line sections printed by adjacent nozzles may be contiguous, spaced, or overlapping, enable a wide range of trade-offs to be implemented with respect to the number of nozzles, the throughput of the print head, and the quality of the printing produced. Thus, the above-described split-segment technique for printing from each nozzle, wherein each nozzle prints two non-contiguous deposit zones DZs separated by a non-deposit zone NDZ, enables each nozzle to have a very wide coverage. This permits the print head to print with half the number of nozzles in two passes, or with the full number of nozzles in a single pass. The described technique also allows the ink drops to be kept very far apart, and thereby minimizes possible interactions between them. Such an arrangement also improves the print quality and machine reliability. In addition, the gutter drops need have practically no charge, (a slight charge may be provided for calibration purposes as described below with respect to FIG. 16), and therefore they minimize possible interference with the writing drops. In case of momentary electrical shorts in the system, undeflected drops would therefore fall into the gutter instead of on the substrate. The novel technique thus combines many of the advantages of both the mono-polar and bi-polar printing configurations, without many of their disadvantages.

The minimum size of the non-deposit zone NDZ is dictated by the width of the gutter 26 (e.g. FIG. 3) which is located on the nozzle axis immediately below the deflection plates 25. Preferably, the non-deposit zone NDZ is about 1-6 mm; and each of the deposit zones $DZ_a$, $DZ_b$, extends from the boundary of the non-deposit zone NDZ to the maximum deflection limit. The maximum deflection may be limited either by the physical free opening in the system, or by the electrical properties of the system. For example, in a typical system, the maximum deflection may extend to about 7 mm on each side of the nozzle, thereby providing a wide coverage for each nozzle.

As described above, FIG. 11 involves a full-overlap configuration, wherein not only the line sections 27 of neighbor nozzles overlap, but also the deposit zones DZs of neighbor nozzles overlap.

FIG. 12, and particularly FIGS. 12*a*-12*d*, illustrate examples of methods that may be used to realize this full overlap without an increase in the total amount of ink. Thus, FIG. 12 illustrates an overlapping configuration corresponding to that of FIG. 11, while FIGS. 12*a*-12*d* illustrate various interleaving or interlacing arrangements that may be provided in the overlapping deposit zones DZs of nozzle $N_3$ and $N_6$ to blur defects and/or to increase throughput.

In the FIG. 12*a* configuration, each nozzle prints short line segments of data normal to the motion direction. Between lines, relative movement is effected between the substrate and the print head a short distance corresponding to the required distance between lines. Thus the arrangement illustrated in FIG. 12*a* produces an interleaving of the line segments printed by the two nozzles $N_3$ and $N_6$.

FIG. 12*b* illustrates what is produced when the nozzles $N_3$ and $N_6$ are actuated randomly such that the total number of drops to be deposited are randomly divided between the two nozzles. That is, if N % of drops come from one nozzle, (100−N)% of the drops would come from the other nozzle. It will be seen that in the configuration illustrated in FIG. 12*b*, each nozzle would be capable of printing the full line segments even though it prints only part of it.

FIGS. 12*c* and 12*d* illustrate other interlacing arrangements that may be used for interlacing the drops emitted by the two nozzles $N_3$, $N_6$ in each printed line segment, particularly to blur printing defects that may be present in one or more of the nozzles, and/or to increase the throughput of the print head. In the arrangement illustrated in FIG. 12*c*, the interlacing of the drops emitted by the two nozzles $N_3$, $N_6$ is effected according to a pre-fixed distribution ratio of sub-segments for each line segment printed by the nozzles. FIG. 12*d* illustrates the possibility that this pre-fixed distribution ratio of sub-segments may be changed when printing subsequent line segments.

It is to be noted that in FIGS. 12*a* and 12*b*, each nozzle is designed to print the full overlap portions even though it eventually prints only half. In FIGS. 12*c* and 12*d*, however, each nozzle is designed to print only a part of the number of drops, and therefore the throughput can be twice as high.

Figure 15:
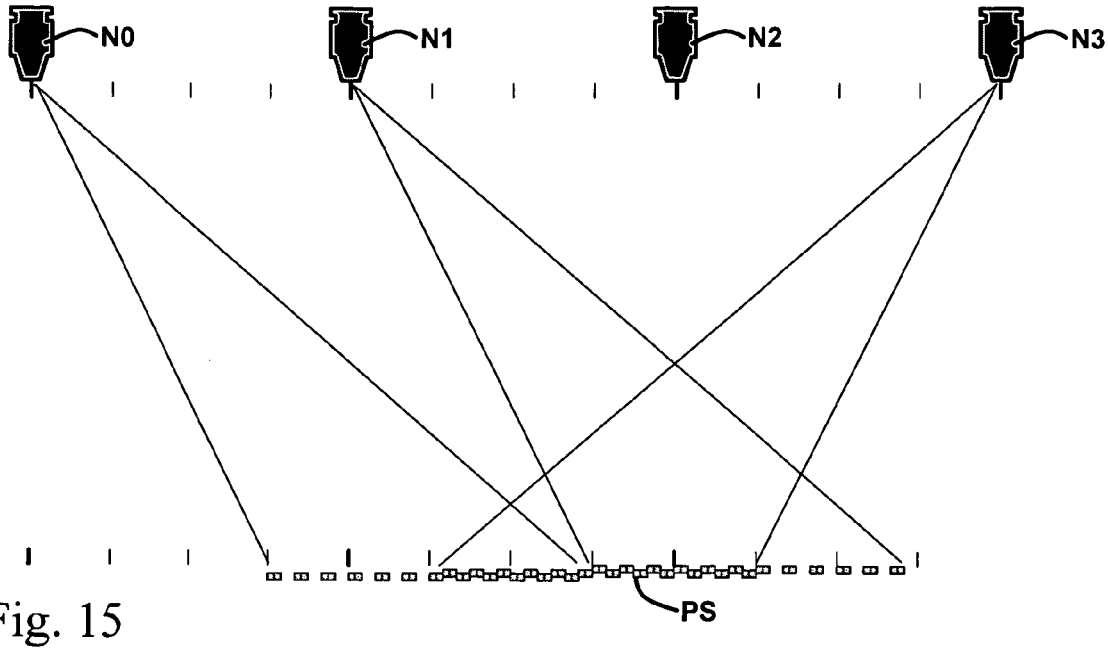
FIG. 15 more particularly illustrates the overlaps in the deposit zones (DZs) of the nozzle configuration in FIG. 14.

While FIGS. 12 and 12*a* -12*d* illustrate interlacing the drops emitted from two nozzles onto a common print segment of the substrate, it will be appreciated that similar configurations can be provided utilizing three or more nozzles for covering the same print segment of the substrate, e.g., as shown in FIGS. 14 and 15 described below.

FIG. 13 illustrates another manner which may used to blur printing defects, namely by side-shifting a complete line of drops a given distance laterally without shifting the data, and changing the side shift when printing different lines. Print defects are directly linked to the structure of the drops fan. Since this side-shift is different from line-to-line, the defects position is also shifted, resulting in a significant blurring effect with respect to the defect, thereby improving the print quality. This is shown in FIGS. 13*a* and 13*b*, illustrating the same nozzle N controlled to produce a side shift $SS_1$ when printing one line (FIG. 13*a*) and a different side shift $SS_2$ when printing another line (FIG. 13*b*). The amount of shifting for each line may be designed to create a pattern that will further blur printing defects.

FIG. 14 illustrates an example of a preferred configuration that may be used for a print head constructed in accordance with the present invention. In FIG. 14, the non-deposit zone NDZ under each nozzle is 6 mm wide; the deposit zone DZ extends to ±7 mm; and the basic printed segment extends from±3 mm to±7 mm. The nozzles are arranged in two rows. Thus, one row includes the oddly-numbered nozzles $N_1$, $N_3$, $N_5$; whereas the other row includes the evenly-numbered nozzles $N_2$, $N_4$, $N_6$; etc. The distance between two nozzles in one row is 8 mm; and the rows are shifted one relative to the other by 4 mm. As a result, the effective distance between two adjacent nozzles is 4 mm.

The printed segments PS of the deposit zones of each nozzle thus overlap the printed segments of its four neighbors, two on each side. This is more clearly illustrated in FIG. 15, demonstrating how, in each print segment PS, the overlap takes place between the nozzles on one side, it being appreciated that a similar overlap occurs on the opposite side. The sub-segments printed by each nozzle are two pixels (drops) wide.

An important element of the above-described printing technique is the size and location of the gutters, (e.g., 26, FIG. 3). Since the gutters cast a non-printing shadow over the substrate, it is important that they be as small and accurately positioned as possible. Therefore, it is desirable to perform a gutter calibration procedure in order to optimize the system performance.

Figure 16:
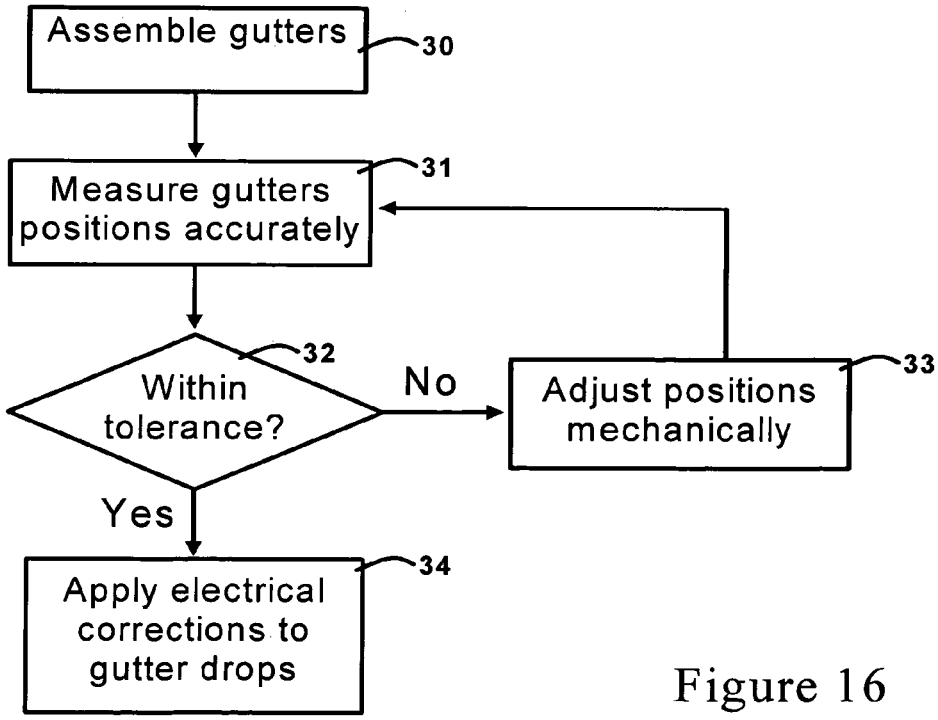
FIG. 16 is a flow chart illustrating a gutter calibration procedure which may be used in order to minimize the size of, and to accurately position, the gutters in a print head constructed in accordance with the present invention.

One such gutter calibration procedure is illustrated by the flow chart of FIG. 16. As illustrated in this flow chart, the gutters are assembled and are mechanically adjusted for the best positioning (block 30). The gutter positions are measured and recorded in the controller (e.g., 28, FIG. 3) preferably using an optical detector (block 31), or a metal detector. The gutter positions are mechanically adjusted until found within the required tolerance (blocks 32, 33). While it is desirable that the gutter drops not be charged, they may be slightly charged, as required, so as to precisely direct the gutter drops of each nozzle to the center of its respective gutter (block 34).

While the invention has been described with respect to several preferred embodiments, it will be appreciated that these are set forth merely for purposes of example, and that many other variations, modifications and applications of the invention may be made.

What is claimed is:

1. A method of inkjet printing a desired pattern on a substrate by means of a plurality of inkjet nozzles arranged in at least one row and having spaced, parallel nozzle axes for emitting liquid ink drops towards the substrate, and multi-level charging and deflecting plates controlled to deflect individual drops to selected locations on the substrate with respect to the respective nozzle axis according to the pattern to be printed; characterized in that the multi-level charging and deflecting plates of the nozzles are controlled to deflect the ink drops of each nozzle to selected locations within a line section for each nozzle, which line section includes two non-contiguous deposit zones to receive ink drops from the respective nozzle, separated by a non-deposit zone not to receive ink drops from the respective nozzle.

2. The method according to claim 1, wherein said non-deposit zone of each nozzle line section is aligned with the respective nozzle axis, and said deposit zones of each nozzle line section are located on opposite sides of the respective nozzle axis.

3. The method according to claim 1, wherein each of said nozzles is controlled to emit a continuous stream of ink drops, and wherein the multi-level charging and deflecting plates of said nozzles are controlled so as to permit those ink drops not to be printed to progress substantially along the respective nozzle axis and to be intercepted by gutters aligned with the respective nozzle axes before reaching the substrate.

4. A method of inkjet printing a desired pattern on a substrate comprising:

controlling a plurality of inkjet nozzles, arranged in at least one row and having spaced, parallel nozzle axes, to emit a continuous stream of liquid ink drops towards the substrate;

and controlling multi-level charging and deflecting plates to deflect individual drops to selected locations in a line section of the substrate for each nozzle according to the pattern to be printed;

characterized in that said multi-level charging and deflecting plates are controlled such that each line section for each nozzle includes two non-contiguous deposit zones to receive ink drops from the respective nozzle, separated by a non-deposit zone not to receive ink drops from the respective nozzle; and such that the ink drops not to be printed are permitted to progress substantially along the respective nozzle axes and to be intercepted by gutters aligned with the respective nozzle axes before reaching the substrate.

5. The method according to claim 4, wherein said non-deposit zone of each nozzle line section is aligned with the respective nozzle axis, and said deposit zones of each nozzle line section are located on opposite sides of the respective nozzle axis.

6. The method according to claim 5, wherein the two deposit zones of each nozzle line section are equal and symmetric.

7. The method according to claim 5, wherein said plurality of inkjet nozzles further include an end nozzle at each end of the row, said multi-level charging and deflecting plates for said end nozzles being controlled to deflect the ink drops therefrom only to the non-deposit zone of the nozzle line section adjacent to the respective end nozzle.

8. The method according to claim 7, wherein said line sections of the row of nozzles are non-overlapping.

9. The method according to claim 8, wherein said line sections of the row of nozzles are contiguous.

10. The method according to claim 8, wherein said line sections of the row of nozzles are spaced from each other.

11. The method according to claim 8, wherein said plurality of nozzles are arranged in at least two rows, in which the nozzles of one row are staggered with respect to those of the other row such that the deposit zones of the nozzle line sections in one row at least partly cover the non-deposit zones of the nozzle line sections in the other row.

12. The method according to claim 8, wherein said plurality of nozzles are arranged in a single row, and said printing on the substrate is effected in two passes of the nozzles with respect to the substrate, in which the second pass is preceded by a lateral shift of the nozzles relative to the substrate in the first pass, such that the deposit zones of the nozzle line sections during the second pass cover the non-deposit zones of the nozzle line sections during the first pass.

13. The method according to claim 4, wherein at least some of said nozzle line sections are overlapping such that the non-deposit zone of a nozzle line section is at least partly covered by a deposit zone of at least one other nozzle line section.

14. The method according to claim 13, wherein the deposit zones of at least some of the nozzle line sections are not overlapping, such that each deposit zone of the respective nozzle line section covers only a part of the non-deposit zone of another nozzle line section.

15. The method according to claim 13, wherein the deposit zones of at least some of the nozzle line sections are overlapping, such that at least a part of the non-deposit zone of the respective nozzle line sections includes a print segment receiving ink drops from at least two other nozzles.

16. The method according to claim 15, wherein at least some of the print segments receiving ink drops from at least two other nozzles receive said ink drops in an interlaced manner.

17. The method according to claim 15, wherein at least some of said print segments receiving ink drops from at least two nozzles receive said ink drops in a random manner.

18. The method according to claim 15, wherein at least some of said print segments receiving ink drops from at least two nozzles receive said ink drops according to a pre-fixed distribution ratio.

19. The method according to claim 18, wherein said pre-fixed distribution ratio is changed when printing subsequent line segments.

20. The method according to claim 15, wherein the deposit zones of at least some of the nozzle line sections are overlapping such that each receives ink drops from at least two nozzles on each side.

21. The method according to claim 4, wherein said multi-level charging and deflecting plates of at least some of said nozzles are controlled to effect a side shift of ink drops emitted therefrom, which side shift is changed when printing different lines, to thereby blur defects with respect to such nozzles.

22. The method according to claim 4, wherein the gutters are constructed with a minimum profile by positioning them in alignment with their respective nozzle axes, measuring their positions with respect to their respective nozzles axes; and when necessary, applying a small electrical charge to the non-printing drops to direct them precisely to the centers of their respective gutters.

23. A method of calibrating an inkjet printer having a plurality of nozzles and a gutter in alignment with each nozzle axis for intercepting ink drops before reaching the substrate, comprising:

measuring their positions with respect to their respective nozzle axes;

positioning the gutters in alignment with their respective nozzle axes;

and when necessary, applying a small electrical charge to the non-printing drops to direct them precisely to the centers of their respective gutters, thereby enabling the gutters to have a minimum profile.

24. Printing apparatus for printing desired patterns on a substrate, comprising:

at least one row of inkjet nozzles having spaced, parallel nozzle axes for emitting ink drops towards the substrate;

multi-level charging and deflecting plates for each nozzle for charging and deflecting the ink drops emitted by the respective nozzle;

and a controller for controlling said multi-level charging and deflecting plates to deflect individual drops to selected locations in a line section of the substrate for each nozzle, which line section includes two non-contiguous deposit zones to receive ink drops from the respective nozzle, separated by a non-deposit zone not to receive ink drops from the respective nozzle.

25. The apparatus according to claim 24, wherein said controller controls said multi-level charging and deflecting plates such that said non-deposit zone of each nozzle line section is aligned with the respective nozzle axis, and said deposit zones of each nozzle line section are located on opposite sides of the respective nozzle axis.

26. The apparatus according to claim 25, wherein said apparatus further comprises a gutter for each nozzle substantially aligned with the nozzle axis of the respective nozzle;

and wherein said controller controls said nozzles to emit a continuous stream of ink drops towards said substrate, and controls said multi-level charging and deflecting plates to permit the ink drops not to be printed to progress substantially along the respective nozzle axis and to be intercepted by gutters aligned with the respective nozzle axis before reaching the substrate.

27. The apparatus according to claim 26, wherein said plurality of inkjet nozzles further include an end nozzle at each end of the row, said multi-level charging and deflecting plates for said end nozzles being controlled to deflect the ink drops therefrom only to the non-deposit zone of the nozzle line section adjacent to the respective end nozzle.

28. The apparatus according to claim 26, wherein said controller controls said multi-level charging and deflecting plates such that said line sections of the row of nozzles are non-overlapping.

29. The apparatus according to claim 26, wherein said plurality of nozzles are arranged in at least two rows, in which the nozzles of one row are staggered with respect to those of the other row such that the deposit zones of the nozzle line sections in one row coincide with the non-deposit zones of the nozzle line sections in the other row.

30. The apparatus according to claim 26, wherein said plurality of nozzles are arranged in a single row; and said controller effects the printing on the substrate in two passes of the nozzles with respect to the substrate, in which the second pass is preceded by a lateral shift of the nozzles relative to the substrate in the first pass, such that the deposit zones of the nozzle line sections during the second pass at least partly cover the non-deposit zones of the nozzle line sections during the first pass.

31. The apparatus according to claim 26, wherein said controller controls said multi-level charging and deflecting plates such that at least some of said nozzle line sections are overlapping whereby the non-deposit zone of a nozzle line section is at least partly covered by a deposit zone of at least one other nozzle line section.

32. The apparatus according to claim 26, wherein said controller controls said multi-level charging and deflecting plates such that the deposit zones of at least some of the nozzle line sections are not overlapping, such that each deposit zone of the respective nozzle line section covers only a part of the non-deposit zone of another nozzle line section.

33. The apparatus according to claim 26, wherein said controller controls said multi-level charging and deflecting plates such that the deposit zones of at least some of the nozzle line sections are overlapping, such that at least a part of the non-deposit zones of the respective nozzle line sections receives ink drops from at least two other nozzles.

34. The apparatus according to claim 33, wherein said controller controls said multi-level charging and deflecting plates such that the parts of the non-deposit zones receiving ink drops from at least two nozzles receive said ink drops in an interlaced manner.

35. The apparatus according to claim 33, wherein said controller controls said multi-level charging and deflecting plates such that the parts of the non-deposit zones receiving ink drops from at least two nozzles receive said ink drops in a random manner.

36. The apparatus according to claim 33, wherein said controller controls said multi-level charging and deflecting plates such the parts of the non-deposit zones receiving ink drops from at least two nozzles receive said ink drops according to a pre-fixed distribution ratio.

37. The apparatus according to claim 36, wherein said controller controls said multi-level charging and deflecting plates to change said pre-fixed distribution ratio when printing subsequent line sections.

38. The apparatus according to claim 36, wherein said controller controls said multi-level charging and deflecting plates such that the deposit zones of at least some of the nozzle line sections are overlapping to cause each to receive ink drops from at least two nozzles on each side of the respective nozzle.

39. The apparatus according to claim 33, wherein said controller controls said multi-level charging and deflecting plates of at least some of said nozzles to effect a side shift of ink drops emitted therefrom and to change said side shift when printing different lines.

* * * * *